United States Patent [19]

Harper

[11] Patent Number: 4,530,222

[45] **Date of Patent: * Jul. 23, 1985**

[54] CYLINDER LOCKS

[75] Inventor: Barrie S. Harper, Wednesfield, England

[73] Assignee: Chubb Lock & Safe Limited, London, England

[ * ] Notice: The portion of the term of this patent subsequent to May 31, 2000 has been disclaimed.

[21] Appl. No.: 376,445

[22] Filed: May 10, 1982

Related U.S. Application Data

[63] Continuation-in-part of Ser. No. 331,719, Dec. 17, 1981, Pat. No. 4,385,510, said Ser. No. 331,719, is a continuation of Ser. No. 129,805, Mar. 12, 1980, abandoned.

[30] Foreign Application Priority Data

May 11, 1981 [GB] United Kingdom ..... 8114348

[51] Int. Cl.[3] ..... E05B 29/02

[52] U.S. Cl. ..... 70/364 R; 70/375; 70/377; 70/DIG. 42

[58] Field of Search ..... 70/364 R, 364 A, 368, 70/373, 375, 376, 377, DIG. 42

[56] References Cited

U.S. PATENT DOCUMENTS

| | | | |
|---|---|---|---|
| 1,755,847 | 4/1930 | Stevens | 70/364 A |
| 1,990,794 | 2/1935 | McCormac | 70/368 |
| 3,691,799 | 9/1972 | Hoffmann | 70/84 |
| 3,863,476 | 2/1975 | Patriquim | 70/419 |
| 4,385,510 | 5/1983 | Harper | 70/364 R |

FOREIGN PATENT DOCUMENTS

| | | | |
|---|---|---|---|
| 737547 | 9/1955 | United Kingdom | 70/364 R |
| 1030921 | 5/1966 | United Kingdom | 70/364 R |

*Primary Examiner*—Robert L. Wolfe

*Attorney, Agent, or Firm*—Pollock, Vande Sande & Priddy

[57] ABSTRACT

Cylinder locks for use in the locking of doors on opposite sides of a vehicle, each have a single barrel which carries tumblers that abut internal shoulders of the lock casing to obstruct turning of the barrel in an unlocking sense (different for the two locks) until the tumblers are withdrawn into the barrel by initial turning of an inserted key. The barrel in each case is free to turn in the opposite, locking, sense without any obstruction, turning in both senses being opposed resiliently by a coiled spring that embraces a spindle of the barrel externally of the casing. The tumblers of one lock are spaced by a bush forwardly within their barrel as compared with the tumblers of the other lock so that different sets of the cuts of the common key engage the tumblers of the two locks.

9 Claims, 12 Drawing Figures

Fig.9 (a)
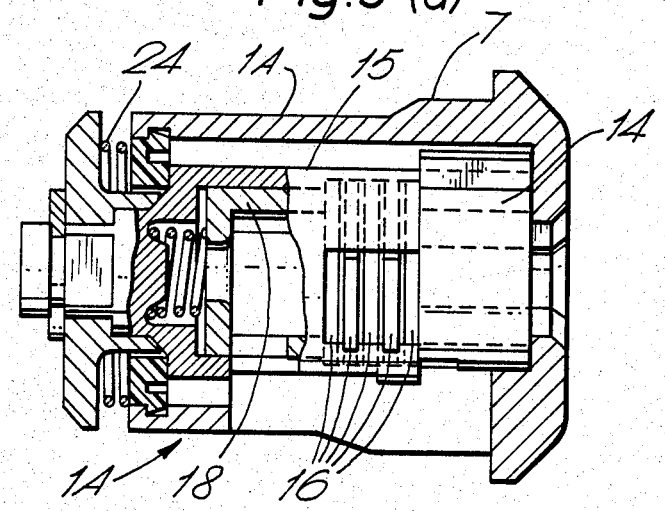
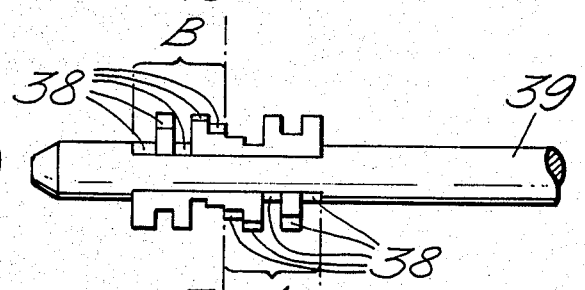
Fig.9(c)
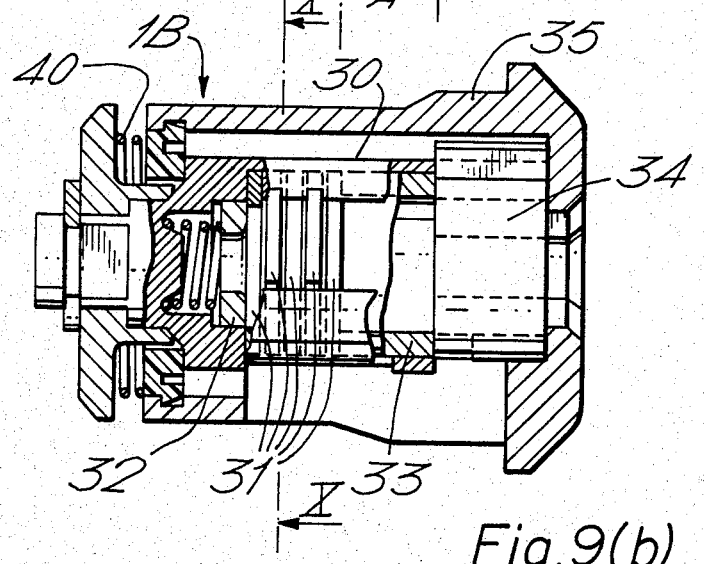
Fig.9(b)

CYLINDER LOCKS

CROSS-REFERENCE TO RELATED APPLICATION

This application is a continuation-in-part of U.S. patent application Ser. No. 331,719 filed Dec. 17, 1981 by the applicant herein, now U.S. Pat. No. 4,385,510; U.S. Ser. No. 331,719 is in turn a continuation of U.S. patent application Ser. No. 129,805 filed Mar. 12, 1980 and now abandoned.

This invention relates to cylinder locks.

The invention is particularly concerned with cylinder locks of the kind (hereinafter referred to as of "the above-specified kind") in which one or more tumblers carried by the single barrel of the lock act to obstruct rotation of the barrel in one, unlocking, direction only until a key inserted into the lock engages with the one or more tumblers to displace them from providing such obstruction by initial turning of the key relative to the barrel in the said one direction from its position of insertion, the barrel is free from obstruction to its rotation in the opposite, locking, direction from that position without such displacement of the one or more tumblers, and a spring device is operative to retain the barrel resiliently in the key-insertion position.

A lock of the above-specified kind is described in French Patent Publication No. 2,067,340. More especially there is described with reference to FIGS. 8 to 11 of French Patent Publication No. 2,067,340 a form of such lock in which rotation of the barrel in one direction is obstructed by a bolt or bar that is held engaged between the barrel and a shoulder of the lock-casing by rotatable disc-tumblers within the barrel. The tumblers maintain this obstruction until a key inserted to engage them has been rotated in the said one direction through ninety degrees relative to the barrel to align notches in the tumblers with the bar so as to enable it to be received into the barrel clear of the obstructing shoulder. The barrel is however free to turn with the key in the reverse direction from the position of key insertion, the bar in this case moving with the barrel away from the shoulder obstruction into an annular clear space between the barrel and the lock casing. The radial dimension of this space is limited so that while the barrel is turned in this direction away from the key-insertion position the bar is maintained projecting into the barrel to engage specially-provided recesses in the tumblers. This ensures that the return rotation of the key engaged directly with the tumblers is communicated to the barrel and precludes relative rotation between the tumblers and the barrel in their return to the key-insertion position. A spring-biased ball acts between the barrel and the lock-casing to latch or index the barrel in this position once returned to it.

The complication, and therefore cost, of construction of the known form of lock is significantly increased by the need to incorporate a spring-biased ball for indexing the barrel in the key-insertion position, and to make special provision for retention of the barrel with the tumblers while the key is being turned back to that position during locking. More especially in the latter respect, the specially-provided recesses in the tumblers and the radial limitation of the annular spaces involved in achieving the retention of the barrel with the tumblers, require to be of close tolerance in any practical realisation of the known lock. Furthermore, there is no obvious way in which the principle of the known lock can be applied in the utilization of other tumbler mechanisms such as for example as known from UK Patent Specification No. 1,030,921; in these latter tumbler mechanisms the tumblers have arms that project from the barrel to obstruct rotation and are withdrawn into the barrel to free it, upon the initial turning of the key relative to the barrel.

It is an object of the present invention to provide a form of lock of the kind specified which is of simplified construction as compared with the lock known from French Patent Publication No. 2,067,340 and which is of more general application.

According to the present invention there is provided a cylinder lock of the above-specified kind wherein the spring device exerts a resilient bias on the barrel throughout turning of the barrel with the key in the locking direction from the position of key insertion, and the resilient bias urges the barrel to return positively to the key-insertion position with the returning key from that direction.

With the lock according to the present invention the spring device is utilized to urge the barrel to return to the key-insertion position so as to avoid the necessity for any special provision within the tumbler mechanism itself as provided in the earlier, known lock, for retaining the barrel to turn with the tumblers while the key is being returned from the locking direction. Since the technique involved in the present invention does not require special provision within the tumbler mechanism used, it can be readily applied more generally than that involved in the earlier, known lock.

The spring device may simply be a coiled spring that acts on the barrel to urge it to return to the position of key-insertion for either direction of rotation. In this respect the spring device may by itself provide adequate indexing of the barrel in the key-insertion position, and so by utilizing this one device it is possible to effect considerable simplification as compared with the earlier, known form of lock. Moreover it is readily possible to locate the coiled spring externally of the tumbler mechanism of the lock and thereby simplify assembly.

The cylinder lock of the present invention is of especial advantage, in particular because of the above-mentioned simplification of construction, in the provision of locks for motor vehicles. More particularly it is advantageous in the provision of pairs of motor-vehicle door-locks which are for use on opposite sides of the vehicle and which are operable by the same key to unlock respective doors, one by turning in the clockwise sense and the other by key-turning in the counter-clockwise sense so that unlocking on either side of the vehicle is always, say, by turning the key towards the front of the vehicle. An earlier form of lock suitable for this purpose is described in UK Patent Specification No. 2,045,854, but this earlier lock, which utilizes two sets of tumblers carried by two intercoupled barrels, tends to be generally longer than can be conveniently accommodated in certain vehicle doors. The lock of the present invention utilizes a single barrel and so in general has the advantage over the earlier lock that it can be constructed in a shorter form, and is thereby capable of wider application.

A vehicle-door lockset comprising two cylinder locks in accordance with the present invention will now be described, by way of example, with reference to the accompanying drawings, in which:

FIG. 9 shows the two locks of the set and their common key together in the one figure for ease of comparison of the locks with one another and with the key, the first and second locks being shown in sectional side-elevation at (a) and (b) respectively, and part of the key at (c)

The lockset illustrated in the accompanying drawings will be described in the context of the locking of doors of a motor vehicle. More especially the two locks of the set, identified individually as locks 1A and 1B, will be described as mounted in doors on opposite sides of the vehicle.

Figure 1:
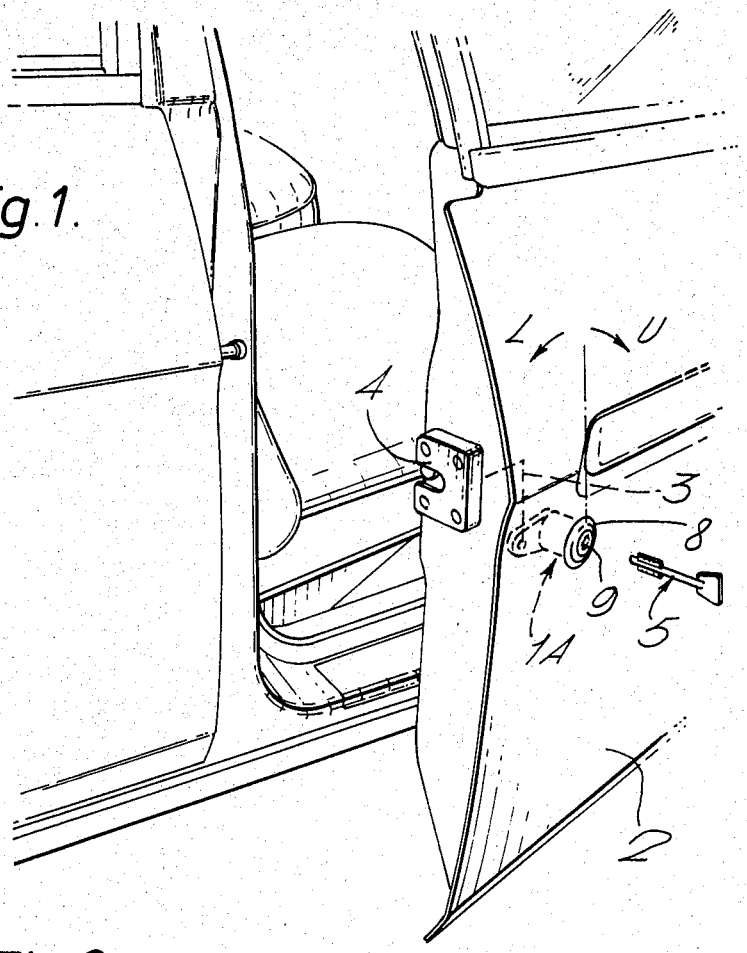
FIG. 1 illustrates the mounting of a first of the two cylinder locks in one of the two front doors of a vehicle.
Figure 2:
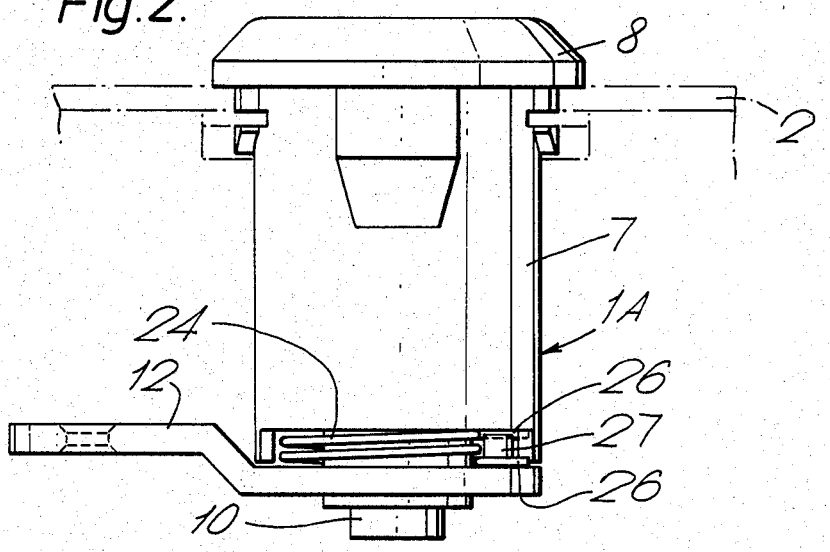
FIGS. 2 and 3 are a plan view and a front elevation respectively of the first lock.
Figure 3:
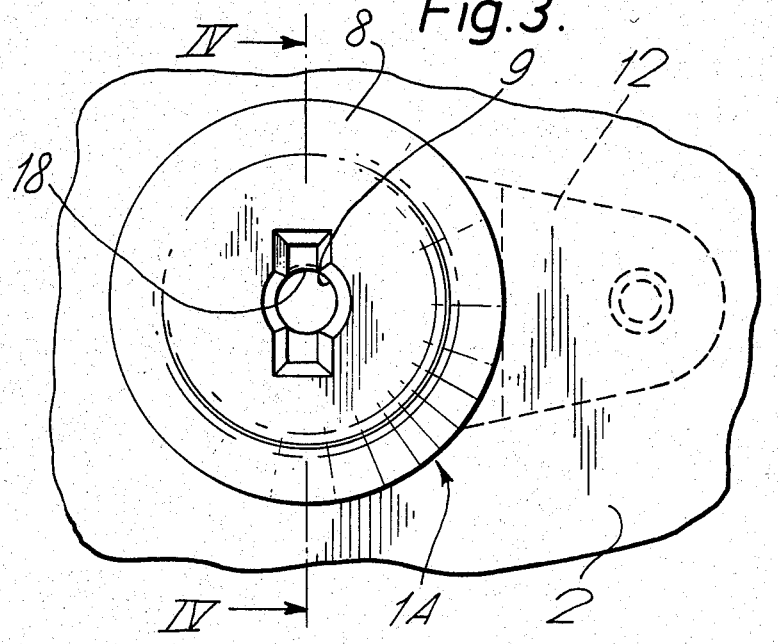

Referring to FIG. 1, the lock 1A is mounted in the door 2 on the left-hand side (as viewed from the front) of the vehicle, and is coupled by linkage 3 to a latch 4 of the door 2. Operation of the lock 1A to effect, via the latch 4, locking and unlocking of the door 2 requires insertion of an appropriate key 5 into the lock 1A and turning of that key in one or the other of two directions, indicated as L and U, from the position of key insertion. Locking of the door 2 when closed, requires turning of the key 5 in the counter-clockwise direction L towards the rear of the vehicle, and then back to return it to the insertion position before withdrawal, whereas unlocking requires turning in the opposite, clockwise direction U towards the front of the vehicle, and then back again to the insertion position, before withdrawal.

The other lock 1B (not shown) of the set is mounted in a door on the opposite, right-hand, side of the vehicle, and is similarly coupled to a latch for controlling the locking and unlocking of that door. Locking and unlocking of this door, like that of the door 2, requires insertion of an appropriate key into the lock 1B and initial turning of the key in directions that are, respectively, towards the rear and front of the vehicle; however, because the lock 1B is on the opposite side of the vehicle these directions of turning are of opposite hand to those applicable to the lock 1A, being clockwise for locking and counter-clockwise for unlocking.

The two locks 1A and 1B are both operable by the same key 5, and are of the same fundamental construction as one another but with differences to enable that same key to be used with the reversal of hand of operation as between them required. The features of construction common to the locks 1A and 1B, together with those particular to the lock 1A, will now be described also with reference to FIGS. 2 to 8.

Figure 4:
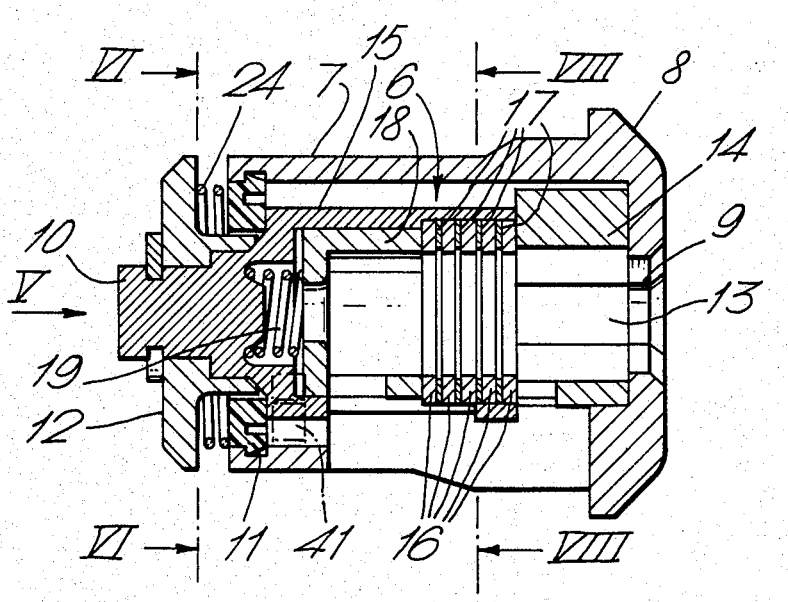
FIG. 4 is a sectional side-elevation of the first lock, the section being taken on the line IV—IV of FIG. 3.
Figure 5:
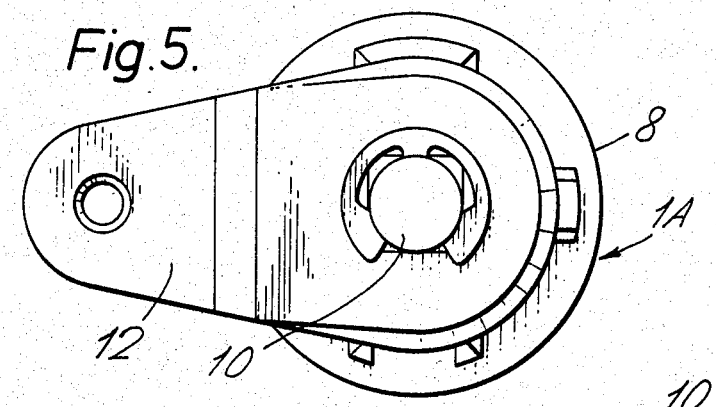
FIGS. 5 and 6 are a rear view and a sectional end-elevation taken respectively in the direction of the arrow V and on the line VI—VI of FIG. 4.
Figure 6:
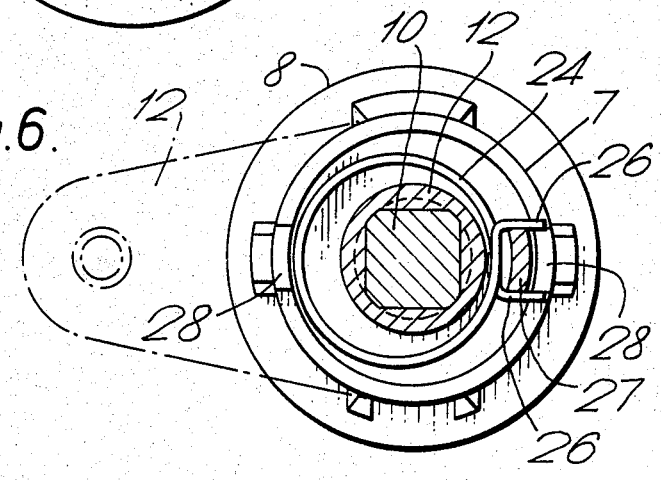
Figure 7:
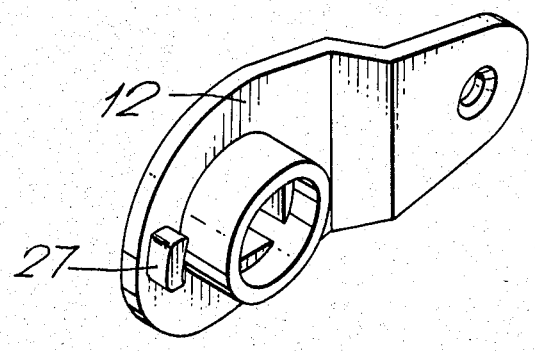
FIG. 7 is a perspective view of a lever forming part of the first lock.

Referring especially to FIGS. 2 to 6, the key-operable tumbler mechanism 6—see FIG. 4—of the lock 1A is contained within a cylindrical die-cast casing 7 that has a flange 8 located at the forend of the lock. The flange 8, which is for use in clamping the lock in the vehicle door 2 provides a keyhole 9 for entry of the key 5 to the mechanism 6 within the casing 7. A spindle 10 of the mechanism 6 projects through a resiliently-retained bush 11 that closes the rear-end of the casing 7, and carries a lever 12—shown in detail in FIG. 7—for coupling via the linkage 3 to the door latch 4. Until the appropriate key 5 is inserted in the keyhole 9 and turned, the mechanism 6 as a whole, is restrained from turning with the casing 7. However when the appropriate key 5 is inserted and turned, the mechanism 6 is freed to turn with the key 5 through a substantial angle in either direction from the position of key insertion. The spindle 10 and lever 12 turn as one with the mechanism 6, and the door latch 4 is responsive via the linkage 3 to the deflection of the lever 12 to lock or unlock the door 2 according to the sense of the deflection. In the present case, clockwise rotation (direction of arrow U in FIG. 1) of the key 5—as viewed from the forend of the lock 1A—is required to unlock the door, whereas counter-clockwise rotation (direction of arrow L in FIG. 1) is required to lock it. The lever 12 turns back upon return of the key 5 to the key-insertion position for withdrawal, but the latch 4 is unresponsive to this return movement, leaving the door 2 locked or unlocked until the key 5 is again inserted in the keyhole 9 and turned in the clockwise or counter-clockwise sense, respectively.

Referring more especially to FIG. 4, the keyhole 9 is continued as a slot 13 through an insert 14 that is restrained from rotation within the casing 7. The insert 14 incorporates a shutter (not shown) which is spring biased to cover the slot 13 and which is deflected back clear of the slot 13 under the thrust of the key 5 as it is entered through the keyhole 9 into the tumbler mechanism 6.

The tumbler mechanism 6 includes a cup-shape barrel 15 which incorporates the rearwardly-projecting spindle 10 and which contains a pack of five tumblers 16 that are separated from one another by four spacing washers 17. The pack of tumblers 16 is urged tightly onto the rear of the insert 14 by a plastics bush 18 acted upon by a spring 19 that abuts the closed end of the cup-shape barrel 15.

Figure 8:
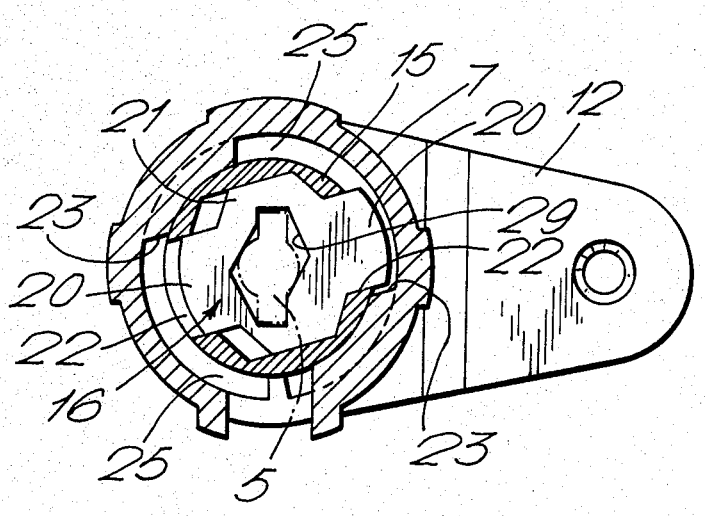
FIG. 8 is a sectional end-elevation taken on the line VIII—VIII of FIG. 4.

As illustrated in FIG. 8, each tumbler 16 has two arms 20 that extend in opposite directions to one another from an apertured bellied-portion 21 into two slots 22 respectively in the cylindrical wall of the barrel 15. The inside configuration of this wall is such as to enable each tumbler 16 freedom to move transversely of the barrel 15 with its arms 20 sliding in the slots 22. The overall width of each tumbler 16 measured across the arms 20 equals the external diameter of the barrel 15, and according to the transverse location of the individual tumbler 16 within the barrel 15, so either it is withdrawn to be contained wholly within the compass of the barrel 15, or one or the other of its two arms 20 projects. It is only when all five tumblers 16 are withdrawn into the barrel 15 so that none of the arms 20 projects therefrom, that the barrel 15 is freed for turning in the clockwise sense; turning of the barrel 15 in this sense is otherwise obstructed, (as illustrated in FIG. 8), by abutment of those of the arms 20 that project (in either direction) from the barrel 15, with shoulders 23 within the cylindrical casing 7.

The barrel 15 is biased by a coiled spring 24 mounted externally of the casing 7 to adopt a zero or key-insertion position in which the arms 20 of the extended tumblers 16 are close to abutment with the shoulders 23 to obstruct turning of the barrel 15 in the clockwise sense from this position. Turning of the barrel 15 in the opposite, counter-clockwise sense from this position is not however obstructed even while the arms 20 remain extended, there being clear spaces 25 within the casing 7 between the shoulders 23 allowing some 60 degrees of freedom in this sense of turning. Such turning is however opposed by the spring 24 which acts via the lever 12 keyed to the spindle 10, to bias the barrel 15 back into the key-insertion position whichever direction the barrel 15 is turned from that position. In the latter respect the spring 24, which embraces the spindle 10 between the bush 11 and the lever 12, has its two ends 26 crossed over one another and extending either side of a lug 27 that projects forwardly from the lever 12, to bear on opposite flanks of a lug 28 of the casing 7—see FIG. 6. Turning of the barrel 15 in either direction causes the lug 27 to lift one or other of the two ends 26 away from the lug 28 and wind up the spring 24 in the appropriate direction to generate the required return bias.

Insertion of the key 5 in the lock engages it in the apertures 29 of the tumblers 16. When the apertures 29 are in register with one another appropriately to receive the key 5, the tumblers 16 are then all positively located to obstruct rotation, that is to say, one or other of the arms 20 of each tumbler 16 project from the barrel 15. Withdrawal of the tumblers 16 takes place only in response to turning of the key 5 from its position of insertion in the clockwise sense to unlock the door 2. The initial turning of the key 5 in this sense is not followed by the barrel 15 since clockwise turning of the barrel 15 is obstructed by the abutment of the tumblers 16 with the shoulders 23 of the casing 7. However engagement of the clockwise-turning key 5 within the apertures 29 of the tumblers 16 acts to displace them transversely within the barrel 15. Provided the engaged cut of the key 5 is appropriately-related to the aperture-configuration in each case, all tumblers 16 are withdrawn together into the barrel 15 in response to some twenty degrees, or more, of initial turning of the key 5 from its position of insertion. Thus after the initial turning of the key, the barrel 15 becomes free to turn with the key 5. Turning of the key 5 to the full extent to rotate the barrel 15 and provide the clockwise deflection of the lever 12 necessary to operate the door latch 4 to unlock the door 2, can therefore be achieved in this case.

The full extent of rotation of the barrel 15 required to unlock the door 2, is not possible if the wrong cut of key is used since the tumblers 16 are not then all withdrawn, and turning of the barrel 15 accordingly remains obstructed.

When the key 5 (or another) is inserted in the lock 1A and is turned from its insertion position in the counter-clockwise sense (to lock the door 2), the barrel 15 in this case turns with it immediately. The only opposition to such turning apart from friction is provided by the spring 24. The tumblers 16 remain extended but with this direction of turning their projecting arms 20 move through the spaces 25 and are thereby unobstructed. The key can accordingly be turned on to the full extent in the counter-clockwise sense against the return bias of the spring 24 to provide the deflection of the lever 12 necessary to operate the latch 4 to lock the door 2.

Turning back of the key 5 to its insertion position for withdrawal following either clockwise or counter-clockwise turning, restores the lock mechanism 6 under the action of the spring 24 to its initial zero or key-insertion position. During return of the key 5 from clockwise turning, the spring 24 exerts counter-clockwise torque on the barrel 15 to restore the barrel 15 positively to its zero position, but continued turning of the key 5 on in the same sense is required before the key 5 can be withdrawn from the lock. This counter-clockwise turning of the key 5 is continued on, usually by momentum originating from the torque exerted initially by the spring 24 directly, until all the tumblers 16 have been fully extended to obstruct clockwise turning again and have their apertures 29 aligned to enable withdrawal of the key 5. This condition is reached, and is thereby distinctly defined, by the resistance from the spring 24 that meets any attempt to continue turning on through it in the counter-clockwise sense.

The spring 24 acts throughout the return of the key 5 from the counter-clockwise turning required to lock the door 2. As the key 5 engaged with the tumblers 16 is turned back in the clockwise sense, there is a tendency for the tumblers 16 to withdraw into the barrel 15. This tendency is overcome by the torque in the clockwise sense exerted on the barrel 15 by the spring 24 which ensures that all clockwise turning of the key 5 in its return to the key-insertion position is followed positively by the barrel 15. The barrel 15 thus returns to this position with the tumblers 16 fully extended ready for immediate withdrawal of the key 5, and with such position distinctly defined.

The tumblers 16 and the key 5 are constructed in accordance with the principles described in UK Patent Specification No. 1,030,921, to provide different lock combinations or differs. It will be appreciated in this respect also that the number of differs can be changed by use of more or fewer tumblers 16 within the barrel 15 of the lock 1A.

The similarities and differences between the two locks 1A and 1B of the set are illustrated in FIG. 9, where the lock 1A is shown at (a) and the lock 1B at (b).

Figure 10:
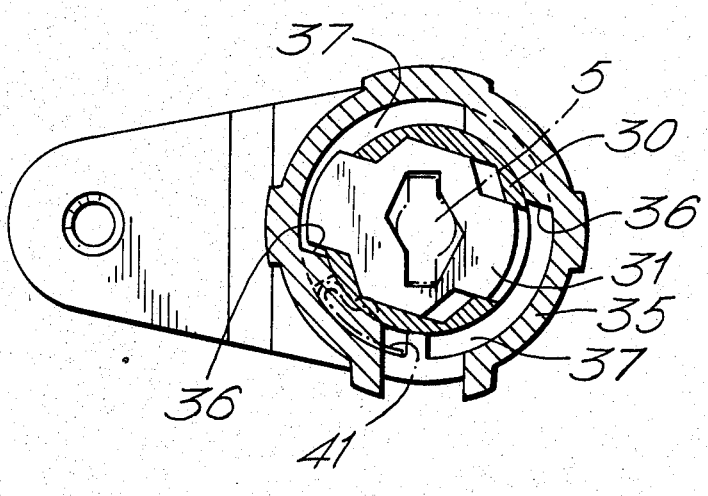
FIG. 10 is a sectional side elevation of the second lock taken on the line X—X of FIG. 9.

Referring to FIG. 9, the lock 1B as shown at (b) is of essentially the same general construction as the lock 1A illustrated at (a), but utilizes a modified barrel 30 in which the tumblers 31 are located rearwardly as compared with the tumblers 16 carried by the barrel 15 of the lock 1A. In this respect the bush 18 of the lock 1A is replaced in the lock 1B by a plastics washer 32, and a plastics bush 33 is inserted intermediate the pack of tumbers 31 and an insert 34 (corresponding to the insert 14 of the lock 1A) at the front of the lock 1B. Furthermore as illustrated in FIG. 10, the tumblers 31 are of opposite hand to the tumblers 16, and the casing 35 in this instance has internal shoulders 36 to be engaged by these tumblers 31 in obstructing counter-clockwise turning of the barrel 30 for unlocking. Turning of the barrel 30 in the opposite sense for locking is clear by virtue of spaces 37 (corresponding to spaces 25 in the lock 1A) between the shoulder 36.

The single key 5 utilized for operating both locks 1A and 1B is illustrated at (c) of FIG. 9. Such key 5 has two sets A and B of cuts 38 displaced from one another along the circular-section key stem 39. Insertion of the key 5 in the lock 1A locates the set A of five cuts 38 within the five tumblers 16 respectively, such that clockwise turning of the key 5 withdraws the tumblers 16 from their obstruction to unlocking. On the other hand, insertion of the key 5 in the lock 1B locates the set B of five cuts 38 within the five tumblers 31 respectively, such that counter-clockwise turning of the key 5 withdraws the tumblers 31 from their obstruction to unlocking of the lock 1B.

With both locks 1A and 1B of the set, the return of the lock mechanism to the key-insertion position is achieved simply by means of a coiled spring, in the case of the lock 1A the spring 24 and in the case of the lock 1B a corresponding spring 40. Such spring ensures adequate indexing of the lock mechanism and moreover ensures that the barrel and tumblers turn as one with the tumblers fully extended, when the key is returned to the key-insertion position from turning in the direction for locking.

If more distinct indexing is required this may be achieved by a modification which is illustrated for the lock 1A in FIG. 4 only, and for the lock 1B in FIG. 10 only. According to this modification a leaf spring 41 is trapped between the casing and barrel of the respective lock to engage in a notch in the outer cylindrical surface of the barrel when the lock mechanism is in the key-insertion position.

I claim:

1. In a cylinder lock in which one or more tumblers carried by a barrel of the lock act to obstruct rotation of the barrel in one, unlocking, direction only, until a key inserted into the lock engages with the one or more tumblers to displace them from providing such obstructions by initial turning of the key relative to the barrel in the said one direction from its position of insertion, the barrel is free from obstruction to its rotation in the opposite, locking, direction from that position without such displacement of the one or more tumblers, and a spring device is operative to retain the barrel resiliently in the key-insertion position, the improvement wherein all tumblers of the lock are carried by one barrel only, the spring device exerts a resilient bias on the said one barrel throughout turning of the barrel with the key in the locking direction from the position of key insertion, and the resilient bias urges the said one barrel to return positively to the key-insertion position with the returning key from that direction.

2. A cylinder lock according to claim 1 wherein the spring device also opposes resiliently turning of the said one barrel with the key in the unlocking direction from the position of key insertion.

3. A cylinder lock according to claim 1 or claim 2 wherein the spring device is a coiled spring.

4. A cylinder lock according to claim 1 wherein the said one barrel has a rearwardly-projecting spindle, said spring means is a spring which embraces the spindle externally of the tumbler mechanism of the lock, and the lock includes means for coupling said spring to the said one barrel to oppose resiliently turning of the barrel in either direction from the position of key-insertion.

5. A cylinder lock according to claim 1 including casing means enclosing the tumbler mechanism of the lock, a coiled spring having two ends that bear resiliently on the casing means, and means carried with the said one barrel to engage selectively one or the other of said two ends for lifting that end from the said casing means in response to turning of the said one barrel from the key-insertion position to exert resilient bias on the said one barrel back towards that position, the particular one of the two ends of said spring that is lifted as aforesaid being dependent upon the direction in which the said one barrel turns from the key-insertion position.

6. A key-operable cylinder lock which is responsive to turning of an inserted key in opposite directions from its position of insertion in the lock to effect locking and unlocking actions, and which comprises casing means having shoulder means therein, a single barrel mounted for rotation in both said directions within said casing means, displaceable tumbler means all carried with the said single barrel to abut said shoulder means and thereby provide obstruction to turning of the barrel in one, unlocking, direction from the key-insertion position, said tumbler means engaging with the inserted key for displacement of the tumbler means to break said abutment with the shoulder means, and thereby withdraw said obstruction, in response to initial turning of the inserted key in said unlocking direction, and said shoulder means being located to provide an abutment as aforesaid for the tumbler means only for turning of the barrel in the unlocking direction from the key-insertion position so that the barrel is free to turn in the locking direction from that position, and spring means operative in response to turning of the barrel in either direction from the position of key insertion to exert force resiliently tending to return the barrel to that position.

7. A cylinder lock according to claim 6 wherein said tumbler means comprises a plurality of tumblers each having an arm for projecting from said barrel to abut said shoulder means, and each being displaceable in response to turning of the inserted key in the unlocking direction from the key-insertion position to withdraw the said arm within the barrel.

8. In a vehicle, a pair of key-operable cylinder locks both operable by the same key and mounted on opposite sides of the vehicle fron one another, each lock being responsive to turning of the key in opposite directions from its position of insertion in the lock to effect locking and unlocking actions, and each lock comprising casing means having shoulder means therein, a barrel mounted for rotation in both said directions within said casing means, displaceable tumbler means carried with the barrel to abut said shoulder means and thereby provide obstruction to turning of the barrel in one, unlocking, direction from the key-insertion position, said tumbler means engaging with the inserted key for displacement of the tumbler means to break said abutment with the shoulder means, and thereby withdraw said obstruction, in response to initial turning of the inserted key in said unlocking direction, and said shoulder means being located to provide an abutment as aforesaid for the tumbler means only for turning of the barrel in the unlocking direction from the key-insertion position so that the barrel is free to turn in the locking direction from that position, and spring means operative in response to turning of the barrel in either direction from the position of key insertion to exert force resiliently tending to return the barrel to that position, and wherein the unlocking directions are opposite for the two locks.

9. A pair of key-operable cylinder locks according to claim 8 wherein spacing means is carried by the barrel of each lock, the spacing means of one of the two locks is located to one side of the tumbler means in the barrel of that lock whereas the spring means of the other lock is located to the other side of the tumbler means in the barrel of that other lock so that as between the two locks their said tumbler means are displaced with respect to one another longitudinally of the barrel.

* * * * *